United States Patent [19]

Lohse et al.

[11] Patent Number: 4,911,415

[45] Date of Patent: Mar. 27, 1990

[54] HOLDER FOR THE PARTIAL HEAT TREATMENT OF TOOLS IN FURNACES

[75] Inventors: Helmut Lohse, Frankfurt am Main; Oskar Bohlaender, Grosskrotzenburg; Hans Sverka, Langenselbold, all of Fed. Rep. of Germany

[73] Assignee: Degussa Aktiengesellschaft, Frankfurt am Main, Fed. Rep. of Germany

[21] Appl. No.: 228,972

[22] Filed: Aug. 5, 1988

[30] Foreign Application Priority Data

Aug. 6, 1987 [DE] Fed. Rep. of Germany ..... 3726134

[51] Int. Cl.[4] ..... C21D 9/22

[52] U.S. Cl. ..... 266/274; 432/253

[58] Field of Search ..... 266/287, 279; 432/253, 432/226

[56] References Cited

U.S. PATENT DOCUMENTS

| | | | |
|---|---|---|---|
| 882,162 | 3/1908 | Parnber | 148/149 |
| 1,925,116 | 9/1933 | Spence et al. | 148/149 |
| 3,615,927 | 10/1971 | Paulson | 148/149 |
| 4,682,011 | 7/1987 | Hoffman et al. | 219/390 |

*Primary Examiner*—S. Kastler

*Attorney, Agent, or Firm*—Beveridge, DeGrandi, Weilacher

[57] ABSTRACT

A holder for work tools to be heat treated in a furnace which holder device is formed of a good heat-conductive metallic material in which are blind holes for the insertion of tools and which is unitary and which is surrounded by a layer of thermal insulation.

5 Claims, 1 Drawing Sheet

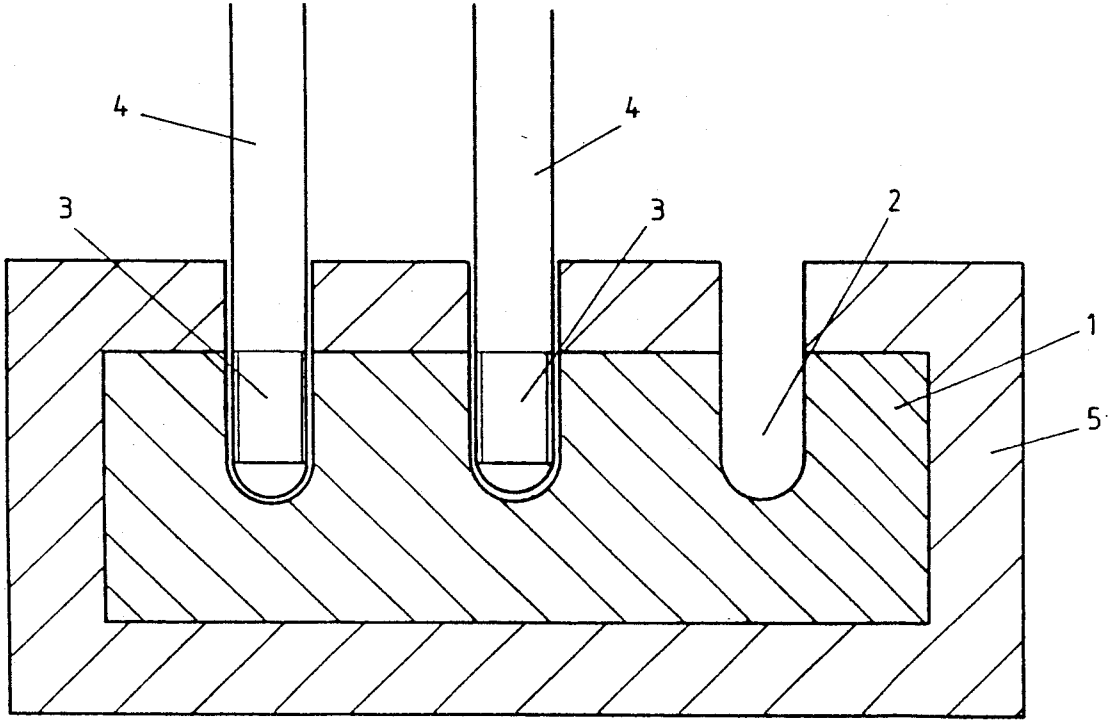
4
4
3
3
2
1
5

HOLDER FOR THE PARTIAL HEAT TREATMENT OF TOOLS IN FURNACES

BACKGROUND

The present invention relates to a metallic holder device provided with blind holes for the partial heat treatment of work tools having a work area and a clamping area in furnaces with homogeneous distribution of heat in the furnace interior, especially for vacuum batch furnaces with compressed-gas quenching.

Drills, milling machine cutters, reamers and similar well known work tools are customarily formed having a clamping area, by which they are fastened in the machine tool chucks and a work area with which the machining or cutting steps are carried out. As a result of the different requirements placed on these areas of the work tool body, the work tools must also exhibit different properties in the respective regions; such as for example strengths. These work tools can therefore be manufactured from two different materials or the two areas of the work tool can be subjected to a differing heat treatment. It is necessary in the case of a unified material to use partial heat treatments which harden only the work area, whereby a longer service life is obtained; the clamping area on the other hand should retain the original technical properties of the material as much as possible. DE-OS 31 11 218 discloses a furnace for the partial heat treatment of tools which exhibit a work area and a clamping area. To this end, the clamping area of the tools is fastened in a holder which is insulated and absorbes a certain amount of calorific energy during the heat treatment so that only the work area is heated over the material-specific transformation temperature and subsequently quenched whereas the clamping area remains at an essentially constant temperature level during the heat treatment and the quenching treatment. To this end, the tools are inserted by their clamping area into boreholes of the plate-like holder which are insulated from the furnace area and are cooled from below.

This furnace has the disadvantage that considerable temperature differences necessarily occur during the heating and the quenching between the work area and the clamping area of the tools which can result in different states of stress in the material and to changes in dimension and form.

DE-OS 33 13 651 corresponding to U.S. Pat. No. 4,682,011 describes a furnace for the partial heat treatment of tools in which the holders are integrated into a plate of heat-insulating material which subdivides the work space of the furnace into two separate heating areas which, for their part, can be heated via separable heating elements to different levels. Thus, special furnaces are required here with movable connecting members between the individual heating elements.

SUMMARY OF THE INVENTION

It is an object of the present invention to provide a metallic holder device with blind insertion holes for use in a furnace for the partial heat treatment of tools exhibiting a work area and a clamping area. The furnace is adapted for homogeneous distribution of heat in the furnace interior, especially for vacuum batch furnaces with compressed-gas quenching. The invention provides for a temperature difference which is as slight as possible between the clamping area and the work area of the tools during the heating period of the heat treatment. The invention avoids heating the clamping area of the work piece to a temperature over the material-specific transformtion temperature. Moreover, during the quenching period, the clamping area experiences as slow a cooling as possible.

In achieving the above and other objects, a feature of the present invention resides in providing a work piece holder device that is surrounded all around with a thermal insulation which bypasses only the openings of the blind holes. The mass of the holder is so great that it can absorb sufficient heat during the time of heating to maintain the temperature of the clamping area of the tools below the transformation temperature. The blind holes are designed in such a manner that a good heat transfer can occur between holder device and work tool contained therein.

BRIEF DESCRIPTION OF THE INVENTION

The invention will be further understood with reference to the drawing which is a schematic representation of a work tool holder device.

DETAILED DESCRIPTION OF THE INVENTION

Described in further detail, the present invention provides a shaped metallic holder body having with blind insertion or bore holes into which the work tools are to be inserted for the partial heat treatment of tools in a furnace. The work tools can be of any conventional type having a working region or area and a region or area where the work piece is clamped or held in the machine such as a milling machine. The furnace is adapted to provide homogeneous distribution of heat throughout the furnace interior, especially for vacuum batch, single-chamber furnaces with compressed-gas quenching. The metallic holder is characterized in that it is unitary and it is surrounded all around with a thermal insulation which bypasses only the openings of the blind holes. Moreover, the mass of the holder is so great that it can absorb sufficient heat during the time of heating to maintain the temperature of the clamping area of the tools below the transformation temperature of the metallic material used for the tools. The blind holes are designed in such a manner that good heat transfer can occur between holder and tool. The holder is designed for at least one, preferably a plurality of blind holes.

When the work tools are heated above the transformation temperature of the metallic material, the heat flowing from the work area of the tools into the clamping area is removed into the metallic holder into which no heat from the furnace interior can flow due to the thermal insulationon all sides. The holder mass must be sufficiently great that so much heat can be absorbed during the heating time that the temperature of the clamping area of the tools remains below the transformation temperature. When the work area of the tool is quenched after the heating phase, the holder then acts as a heat reservoir from which heat flows into the clamping area of the tools, thus bringing about a considerably slower cooling. As a result, no deleterious structural changes occur in the clamping area of the work tool. This largely eliminates the susceptibility of the tools to fracture in the transitional zone between the clamping area and the work area during use.

The blind holes in the holder device of this invention which serve for the insertion of the clamping area of the work tools must be designed in such a manner that good heat transfer can occur between holder device and tool. Thus, the spacing of the blind holes from each other, and the depth of each hole must be such that there is sufficient metallic mass between adjacent holes to provide for sufficient heat transfer so that temperature limitations as set forth above are met. The holder devices of this invention are preferably formed of heat-resistant steels. The precise dimensions thereof; i.e. hole depth and spacing, are a function of the diameter and the number of the tools to be treated. There must be sufficient metallic material present around the particular blind holes so that the temperature in the clamping area does not rise above the transformation temperature of the work tool as a consequence of the absorption of heat during heating.

All known high temperature-resistant materials can be used as insulation material, but no grapite felt. The thickness of the insulation layer is a function of the furnace parameters and method parameters during the heat treatment. For example, the thickness is normaly in a range of 20 to 50 mm. It has been demonstrated in practice that the temperatures in the clamping area are 900°to 1000° C. when temperatures in the work area of the tools are at 1200° C. After quenching, work tools are obtained which exhibit only a very minimum susceptibility to fracture in the transitional zone between work area and clamping area.

The work tool holder of the invention, thermally insulated on all sides, has the advantage that it can be used in practically all heat treatment furnaces, especially also in vacuum furnaces and inert gas furnaces, which are heated on all sides.

The illustration schematically shows a holder in accordance with the invention in an exemplary embodiment in longitudinal section. The holder consists of a unitary steel plate 1 which comprises several blind holes 2 for receiving the clamping area 3 of tools 4. The steel plate 1 is surrounded all around except for the opening of the blind holes 2 by a layer 5 of thermal insulating material. While illustrated as a plate, the holder device of the invention can be any convenient shaped body.

Further variations and modifications of the foregoing will be apparent to those skilled in the art and are intended to be encompassed by the appended claims.

We claim:

1. A holder means adapted to hold metal work tools in a heat treating furnace for partial heat treatment of the tools, said holder means comprising:

a shaped, unitary metallic body having blind insertion holes that are each dimensioned to receive a portion of the work tool, which portion is adapted to be clamped, and a layer of thermal insulation covering all surfaces of said metallic body and provided with an opening coincident with said hole in said body, said body having sufficient metallic mass between each of said holes to absorb sufficient heat from the adapted portion of each tool as work portions of the tools are heated in the heat treating furnace to at least a transformation temperature of the metal and thereby maintain the temperature of the adapted portions of the tools below the transformation temperature, and to provide heat from said absorbed heat to the adapted portions during subsequent cooling of the tools to prevent undesirable structural changes in the adapted portions.

2. The holder means according to claim 1, wherein said holder means has a plurality of coincident holes formed in said body and said insulation layer.

3. The holder means according to claim 1, wherein said insulation layer has a thickness of 20 to 50 mm.

4. The holder means according to claim 1, wherein said body is formed of steel.

5. The holder means according to claim 1 wherein said body is provided in the form of a plate.

* * * * *